United States Patent [19]

Merila

[11] 4,065,028

[45] Dec. 27, 1977

[54] PAPER NAPKIN DISPENSER

[76] Inventor: John B. Merila, 6223 E. 127th St., Grandview, Mo. 64030

[21] Appl. No.: 693,004

[22] Filed: June 4, 1976

[51] Int. Cl.[2] ..... B65H 1/06; B65H 3/26

[52] U.S. Cl. ..... 221/36; 221/39; 312/37

[58] Field of Search ..... 221/33, 36, 38, 39, 221/41, 47, 240; 206/494; 312/37

[56] References Cited

U.S. PATENT DOCUMENTS

| | | | |
|---|---|---|---|
| 1,151,792 | 8/1915 | Jaeger | 221/36 X |
| 2,258,358 | 10/1941 | Harvey | 221/36 X |
| 3,214,058 | 10/1965 | Sergio | 221/36 X |
| 3,259,271 | 7/1966 | Bump | 221/36 |

*Primary Examiner*—Robert B. Reeves
*Assistant Examiner*—Joseph J. Rolla
*Attorney, Agent, or Firm*—John A. Hamilton

[57] ABSTRACT

A dispenser for paper napkins consisting of a housing adapted to support a stack of napkins in such a manner that a flap of the lowermost napkin depends downwardly in the housing by a gravity, and an ejector mounted movably in the housing and operable by reciprocation to engage the depending napkin flap and extend it outwardly through an opening of the housing, where it may be grasped for removal from the housing.

2 Claims, 6 Drawing Figures

PAPER NAPKIN DISPENSER

This invention relates to new and useful improvements in dispensers for paper napkins such as may be used, for example, in restaurants and other public eating places.

An important object of the present invention is sanitation, in that in removing a napkin therefrom, a user does not and cannot touch any other napkin contained therein.

Another object is the provision of a paper napkin dispenser adapted to contain a large number of napkins, and which will reliably dispense one napkin at a time, down to and including the last napkin contained therein.

Generally, these objects are accomplished in connection with napkins which are folded to a rectangular form, the final fold producing two flaps extending unequally from the fold line, the napkins being stacked in the dispenser with their shorter flaps lowermost and all extending in the same direction, the dispenser having a pair of parallel, spaced apart support ledges, the first ledge supporting the stack at its fold edge, and the second supporting the stack at its opposite edge, the shorter flaps not extending to said second support ledge, whereby the shorter flap of the lowermost napkin hangs downwardly between said ledges by gravity, and an ejector horizontally reciprocable in said housing beneath said ledges in a direction normal to said ledges, whereby upon movement of said ejector in one direction, it engages and folds the depending mapkin flap under said first ledge and projects it outwardly through an opening of said housing, where it may be grasped and pulled for removal.

In the removal of a napkin as described, a portion thereof must be pulled around the free edge of the first ledge, with the edge acting as a pulley. To prevent undue friction at this point, which could result in tearing of the napkin, another object is the provision of a slender, rotatable roller along the free edge of the first ledge, which acts as a pulley easing and facilitating the removal of each napkin.

A further object is the provision of a napkin dispense of the character described having an ejector of a special form insuring that it will reliably fold and project the free edge of the shorter napkin flap, rather than merely crumpling it.

Other objects are simplicity and economy of construction, and efficiency and dependability of operation.

Figure 1:
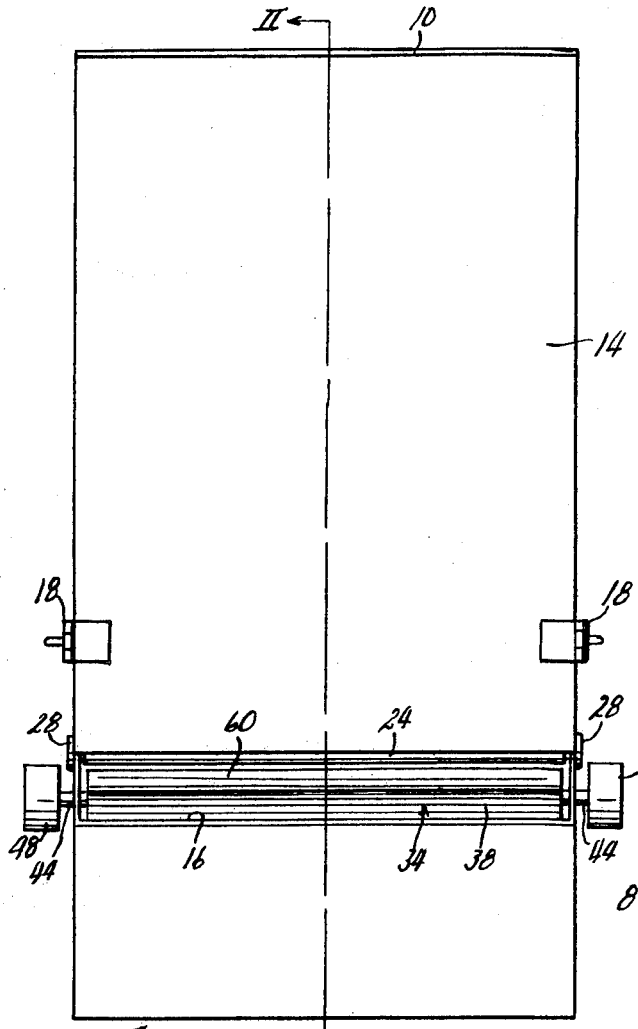
Figure 2:
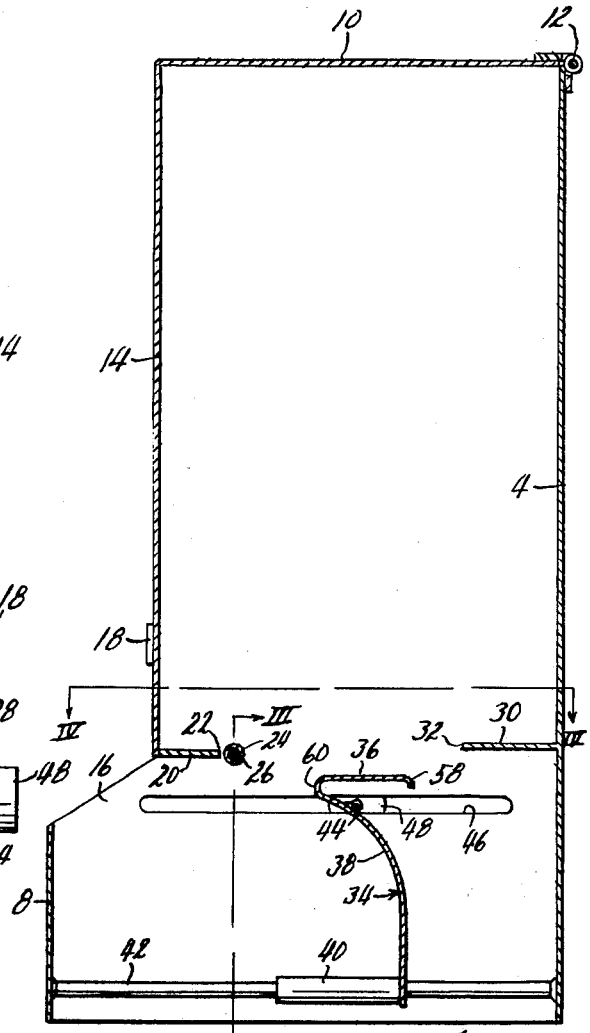
Figure 3:
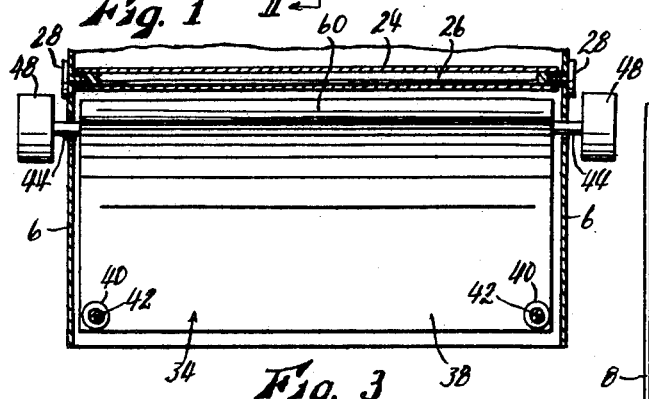
Figure 4:
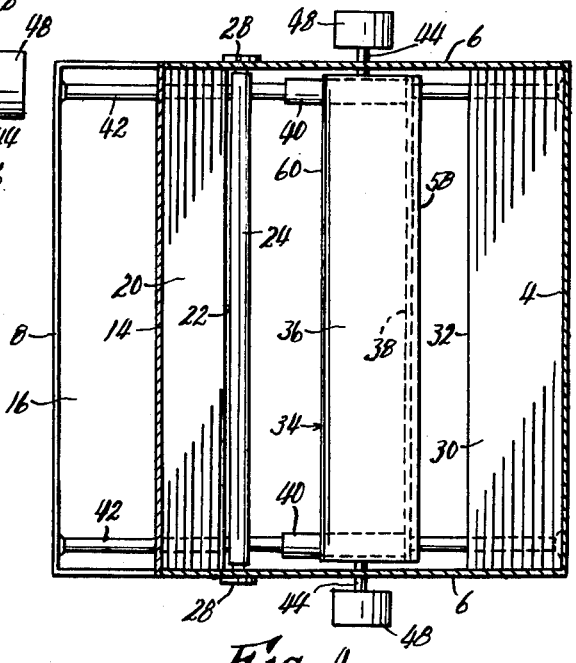
Figure 5:
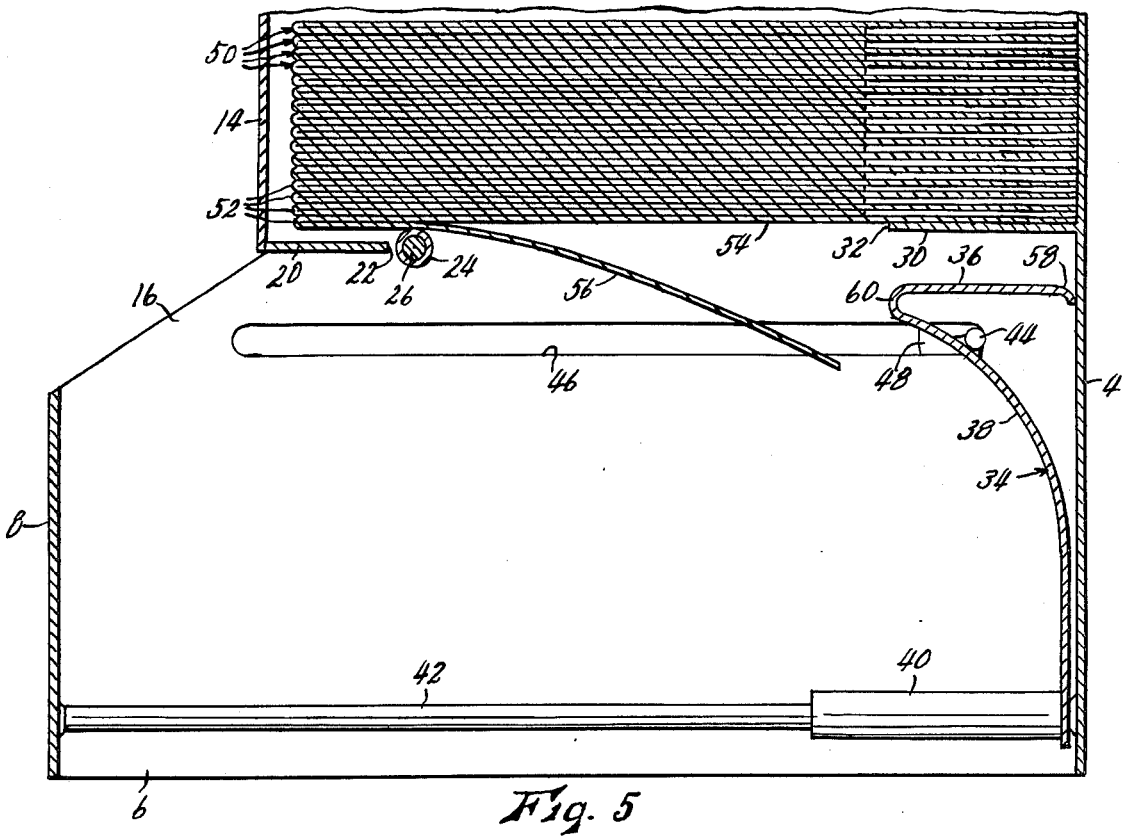
Figure 6:
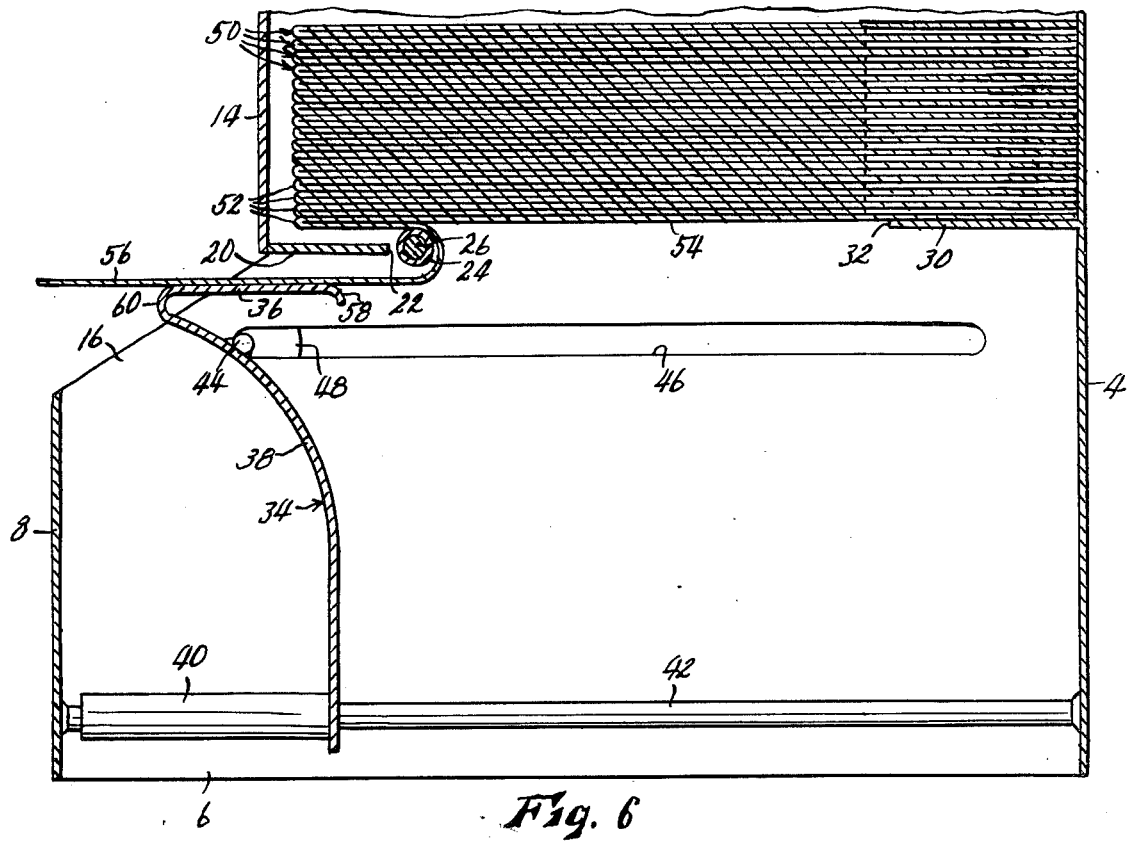

With these objects in view, as well as other objects which will appear in the course of the specification, reference will be had to the accompanying drawing, wherein:

FIG. 1 is a front elevational view of a paper napkin dispenser embodying the present invention, FIG. 2 is a sectional view taken on line II—II of FIG. 1, FIG. 3 is a fragmentary sectional view taken on line III—III of FIG. 2, FIG. 4 is a sectional view taken on line IV—IV of FIG. 2, FIG. 5 is an enlarged fragmentary view similar to FIG. 2, but showing the dispenser containing napkins, and the parts shown positioned preparatory to the dispensing of a napkin, and FIG. 6 is a view similar to FIG. 5, but showing the edge of a napkin extended from the dispenser for removal.

Like reference numerals apply to similar parts throughout the several views, and the numeral 2 applies generally to the housing of the dispense. Said housing is generally rectilinear, being formed of sheet metal or other suitable material, and including a rear wall 4, side walls 6, and a front wall 8 only at the lower front portion thereof. Said housing is provided with a cover including a top panel 10 which is normally horizontal and which is pivoted at its rearward edge to the top edge of rear wall 4 by hinge 12, and a front panel 14, normally vertical, the lower edge of which is disposed somewhat above and behind the upper edge of front wall 8, whereby a dispensing opening 16 is formed therebetween. Said cover may be secured releasably closed by fasteners 18 of any suitable type, the details of which are not pertinent to the present invention, and which may be of either a locking or non-locking type, as desired.

Disposed within housing 2, at the level of the lower edge of front panel 14 of the cover, is a horizontal front ledge 20. Said front ledge is fixed at its end to side walls 6 of the housing, but is not connected to the housing cover. It extends rearwardly only a small fraction of the front-to-rear depth of the housing, and its rearward edge 22 extends laterally of the housing. Just rearwardly of edge 22, parallel to but not engaging it, is a small diameter roller consisting of a tube 24 extending substantially the full width of the housing, and rotatably mounted on a coaxial rod 26 fixed at its ends to housing side walls 6 by screws 28. Generally at the level of front ledge 20, a horizontal rear ledge 30 is fixed in the rearward portion of the housing, said rear ledge being affixed to the side and rear walls of the housing. It extends forwardly only a small fraction of the front-to-rear depth of the housing, and its forward edge 32 extends transversely to said housing.

An ejector 34 is disposed in the lower portion of the housing just beneath the level of ledges 20 and 30. Said ejector is formed of sheet metal, and includes a horizontal top panel 36 extending transversely substantially the full width of the housing, but having a front-to-rear width preferably no greater than the front-to-rear width of rear ledge 30. The front and rear edges of panel 36, extending transversely of the housing, are smoothly rounded as shown. The ejector also includes a front panel 38, integral with top panel 36, which is curved downwardly and rearwardly from the forward edge of the top panel, as best shown in FIGS. 2, 5, and 6, whereby is forward surface is concave with is curvature lying in a vertical plane. At its lower edge, respectively adjacent opposite sides of the housing, a pair of horizontal sleeves 40 are affixed to front ejector panel 38, said sleeves being mounted for sliding movement respectively on a pair of rods 42 extending from front to rear between housing walls 4 and 8, and affixed at their ends to said walls. Thus the ejector may be moved forwardly and rearwardly in the housing along rods 42, the top panel 36 thereof being disposed in closely spaced apart relation beneath the level of ledges 20 and 30 and roller 24. A pair of rods 44 are affixed to the rearward face of front panel 38 of the ejector, respectively at opposite sides thereof. Each of said rods extends laterally outwardly through a slot 46 formed horizontally in the adjacent side wall 6, and has a knob 48 affixed to its outer end. Thus the ejector 34 may be moved forwardly or rearwardly in the housing by manual manipulation of either knob 48, the length of slots 46 limiting ejector movement in either direction. Said ejector may be moved from a rearmost position as shown in FIG. 5, in which the forward edge of its top panel is generally aligned with forward edge 32 of rear ledge 30, to a forwardmost position as shown in FIG. 6, wherein said leading edge of the ejector is disposed well forwardly of cover front panel 14.

The dispenser is adpated to dispense paper napkins 50 as shown in section in FIGS. 5 and 6. It will be undestood that each napkin is folded to a rectangular form of such dimensions that they may be stacked vertically in the housing between side walls 6, rear wall 4, and front cover panel 14, the bottom of the stack resting as its forward edge on front ledge 20 and roller 24, and at its rearward edge on rear ledge 30. It will be understood that each napkin may be folded several times, which is not pertinent to the present invention. It is essential however, that the final fold of each napkin, indicated at 52, be such as to produce a longer flap 54 and a shorter flap 56, as measured by their extension normally to fold 52. If the napkin was folded once or more prior to the final fold 52, each of flaps 54 and 56 may include several layers of paper, but this is immaterial to the present invention.

In use, after fasteners 18 are released and cover 10 - 14 is opened upwardly and rearwardly on hinge 12, napkins 50 are stacked in the housing on ledges 20 and 30, the forward edge portion of the stack resting on ledge 20 and roller 24, and the rearward edge portion of the stack resting on ledge 30, taking care that all of the napkins in the stack are identically oriented, that is, with their shorter flaps 56 lowermost and their final folds 52 extending forwardly. The housing may of course be any desired height to contain any desired number of napkins. The cover may then be closed and secured by fasteners 18. It will be seen that when the napkins are thus inserted, rear ledge 30 does not have sufficient front-to-rear width to extend below and support the shorter flap 56 of the lowermost napkin of the stack, and cannot do so regardless of the possibility of any slight variation in the placement of the napkins in the housing. Hence, shorter flap 56 of the lowermost napkin hangs or depends downwardly into the housing beneath the level of the ledges, by gravity, as shown in FIG. 5.

To dispense a single napkin, ejector 34 is first moved all the way to its rearward position, as shown in FIG. 5, and then to its forward position as shown in FIG. 6, by manual manipulatin of either of knobs 48. If said ejector was, before commencement of its rearward movement, disposed in its forward or some intermediate position, it will during its rearward movement, merely elevate flap 56 of the lowermost napkin and pass freely thereunder, the rearward edge 58 of the ejector being rounded as shown to eliminate any possibility that it could cut or tear the napkin. Since the ejector has a front-to-rear width no greater than that of ledge 30, flap 56 of the lowermost napkin depends in front of the ejector when said ejector is in its rearmost position, as in FIG. 5.

Then, when the ejector is move forwardly, its forward edge 60, also rounded to eliminate any possibility of its cutting or tearing the napkin, engages flap 56 of the lowermost napkin, deflecting it first downwardly, then folding it upwardly and forwardly around roller 24 to rest substantially flat on the top panel 36 of the ejector, as shown in FIG. 6, in which position napkin flap 56 projects horizontally forwardly through dispensing opening 16 of the housing, where it may conveniently be grasped and pulled to complete the removal of the napkin from the dispenser.

As the ejector commences its forward movement, the first engagement thereof with the napkin occurs when the downwardly and rearwardly curved front panel 38 thereof contacts the extreme rearward edge of shorter flap 56 of said napkin. The curvature of said front panel renders it generally parallel to the flap at the line of contact, and hance insures that the flap will be initially deflected downwardly as desired, eliminating any possibility that said flap might be merely compressed or rumpled instead of being deflected. As the extended edge portion of flap 56 is grasped and pulled outwardly from the FIG. 6 position, it is pulled around roller 24, said roller acting as a freely rotatable pulley. This facilitates and eases the withdrawal, and also eliminates the possibility that the napkin might be cut or torn as it is pulled around the rearward edge of ledge 30. However, the dispenser has been found to function acceptably even if roller 24 is eliminated, provided that the rearward edge of ledge 20 is smoothly rounded.

It has been found that, depending on the weight or stiffness of the napkins, there may be a tendency of the napkins to sag or "belly" downwardly, by gravity between roller 24 and the forward edge or rear ledge 30, if the ledges are too narrow from front to rear. However, in experimenting with napkins of many different weights and stiffnesses it has been found that said "bellying" can be eliminated, or at least reduced to the point that it cannot cause malfunctioning of the dispenser, if the combined front-to-rear width of ledges 20 and 30, including roller 24 since it of course serves also as a napkin support, is at least about one-third of the front-to-rear width of the stack of napkins. This proportion, however, is not critical.

While I have shown and described a specific embodiment of my invention, it will be readily apparent that many minor changes of structure and operation could be made without departing from the spirit of the invention.

What I claim as new and desire to protect by Letters Patent is:

1. In combination with a stack of folded paper napkins each having a final fold producing a pair of flaps extending unequal distances from said fold, a dispenser comprising:

a. a housing having a top, a bottom and forward, side and rearward walls for receiving said napkin stack with their final folds extending forwardly and with the shorter flaps thereof lowermost, b. spaced apart ledges fixed in said housing and disposed respectively along the forward and rearward walls of said housing, in spaced relation above the bottom of said housing, and respectively supporting the forward and rearward edge portions of said napkin stack, said rearward ledge being of insufficient forward extent to project beneath the shorter flap of the lowermost napkin of the stack, whereby said flap hangs downwardly between said ledges by gravity, and c. an ejector carried in said housing below said ledges for horizontal forward and rearward reciprocal movement, and including a horizontal top panel extending substantially the full width of said housing in closely spaced apart relation beneath said ledges, and having parallel front and rear edges extending transversely of said housing, the forward edge of said top ejector panel, when said ejector is in its rearmost position, being generally in vertical alignment with the forward edge of said rear ledge, and being disposed, when said ejector is in its forwardmost position, well forwardly of the rearward edge of said front ledge, and a front panel extending the full width of said top panel and being inclined rearwardly and downwardly from the front edge of said top panel, whereby upon forward movement of said ejector, the forward edge of said top ejector panel engages and folds said shorter flap of the lowermost napkin under the rearward edge of said front ledge and projects it outwardly through an opening formed in the front wall of said housing beneath the vertical level of said ledges.

2. The combination as recited in claim 1 wherein said front ejector panel is curved arcuately rearwardly and downwardly from the front edge of said top panel, the axis of said curvature being parallel to said front edge of said top panel.

* * * * *